US011472516B2

(12) United States Patent
Giraldes

(10) Patent No.: US 11,472,516 B2
(45) Date of Patent: Oct. 18, 2022

(54) RAFT SAMPLING BENCH

(71) Applicant: QATAR UNIVERSITY, Doha (QA)

(72) Inventor: Bruno Welter Giraldes, Doha (QA)

(73) Assignee: QATAR UNIVERSITY, Doha (QA)

( * ) Notice: Subject to any disclaimer, the term of this patent is extended or adjusted under 35 U.S.C. 154(b) by 122 days.

(21) Appl. No.: 16/898,213

(22) Filed: Jun. 10, 2020

(65) Prior Publication Data

US 2021/0387701 A1 Dec. 16, 2021

(51) Int. Cl.
*B63B 34/50* (2020.01)
*B63B 73/00* (2020.01)

(52) U.S. Cl.
CPC ..... *B63B 34/50* (2020.02); *B63B 73/00* (2020.01); *B63B 2211/00* (2013.01); *B63B 2231/50* (2013.01)

(58) Field of Classification Search
CPC ..... B63B 34/50; B63B 73/00; B63B 2211/00; B63B 2231/50
See application file for complete search history.

(56) References Cited

U.S. PATENT DOCUMENTS 403,470 A * 5/1889 Henderson ..... B63B 7/06 114/354
605,513 A * 6/1898 Reade ..... B63B 7/06 114/354
1,038,928 A * 9/1912 Menzel ..... B63B 43/14 114/219
1,453,223 A * 4/1923 French ..... B63B 3/16 114/356
1,852,025 A 4/1932 Pocock
2,009,344 A * 7/1935 Ragsdale ..... B64C 35/003 244/105
2,338,976 A * 1/1944 Schutte ..... B63B 7/082 114/345
2,697,235 A * 12/1954 Gronli ..... B63B 3/40 114/82
2,866,985 A 1/1959 Blackmore
2,986,749 A 6/1961 Webber et al.
3,092,850 A * 6/1963 Klopstock ..... B63B 5/10 114/358
3,174,166 A 3/1965 Ehrenberg et al.
3,732,587 A 5/1973 Fletcher
(Continued)

FOREIGN PATENT DOCUMENTS

DE 2423020 A1 1/1986

OTHER PUBLICATIONS

2020 Game and Wildlife Conservation Trust, "Building a GWCT Mink Raft", https://www.gwct.org.uk/advisory/guides/mink-raft-guidelines/building/, Charity registered in England and Wales, 1112023, in Scotland SCO38868, 7 pages.

*Primary Examiner* — S. Joseph Morano
*Assistant Examiner* — Jovon E Hayes
(74) *Attorney, Agent, or Firm* — Squire Patton Boggs (US) LLP

(57) ABSTRACT

A shallow draft sampling raft including a bow, and a stern, in which the bow is an opposite end of the raft from the stern. The raft also includes a top surface, a bottom surface, and a plurality of longitudinal stringers. The plurality of longitudinal stringers are attached to an inner face the bottom surface and run from the bow to the stern. A top surface is also attached to the longitudinal stringers.

20 Claims, 5 Drawing Sheets

(56) References Cited

U.S. PATENT DOCUMENTS

| | | | | |
|---|---|---|---|---|
| 4,120,632 | A * | 10/1978 | Stoeberl | B29C 33/20 264/46.8 |
| 4,214,332 | A * | 7/1980 | Stoner | B63B 3/09 114/65 R |
| D279,668 | S | 7/1985 | Larsson | |
| 5,239,940 | A | 8/1993 | Griffin | |
| 5,421,283 | A | 6/1995 | Bruggemann et al. | |
| 6,044,789 | A * | 4/2000 | Kurzman | B63B 7/04 441/35 |
| 6,926,468 | B2 | 8/2005 | Sehl | |
| D510,062 | S | 9/2005 | McCormack | |
| D629,484 | S | 12/2010 | Jackson | |
| 8,931,752 | B2 * | 1/2015 | Roberts | B63B 3/38 249/162 |
| 9,580,148 | B1 | 2/2017 | Isaacs | |
| 2010/0058971 | A1 * | 3/2010 | Rixford | B63B 34/23 114/352 |
| 2017/0106944 | A1 * | 4/2017 | Smith | A45F 4/10 |
| 2017/0355427 | A1 | 12/2017 | Ruiz | |

* cited by examiner

RAFT SAMPLING BENCH

BACKGROUND

Field

Certain embodiments may generally relate to marine crafts. More specifically, certain embodiments may relate to shallow draft sampling rafts or vehicles which can also be used as a scientific bench for marine science surveys in various conditions, including shallow water.

Description of Related Art

There are many types of rafts, boats, barges, scientific benches, and boards. However, each fails to provide all of the functionality to perform marine science surveys in shallow subtidal zones. For example, boards (e.g., paddle boards, surf boards, etc. . . . ) are usually fragile and require balance and concentration to load and transport heavy material.

Small boats are sometimes used for marine science; however, most boats have V-bottom hulls and are not suitable for use in shallower depths. Conventional barges are also inadequate options because of their large size. Many sites in which marine science and research is conducted require a marine raft, craft, or vessel (hereinafter "raft") to be transported in the back of a land vehicle such as a pickup truck or attached to the roof of a car. For example, intertidal zones that include mangroves, seagrass, oyster beds, algae beds, and coral reefs, may contain nurseries and ecosystems that may be important natural resources, and often these important ecosystems are almost inaccessible for scientists because of the long distances from the shoreline to the subtidal slope. Consequently, conventional small boats and barges are poor options because they may require a loading ramp that is usually not available, and/or they may not be able to move effectively through the different ecosystems.

Therefore, there is a need for a shallow draft marine raft that is lightweight, stable, inexpensive, and easily portable.

SUMMARY

In accordance with some certain embodiments, a marine raft may include a bow, a stern, and a top surface, wherein the bow is an opposite end of the raft from the stern. The marine raft further includes plurality of longitudinal stringers, wherein the plurality of longitudinal stringers is attached to an upper inner face of the top surface and runs from the bow to the stern. The marine raft further includes a bottom surface, wherein a lower inner face of the bottom surface is attached to the plurality of longitudinal stringers. The marine raft further includes a plurality of hull sides, wherein the plurality of hull sides is attached to the upper inner face and the lower inner face, and the plurality of hull sides are curved toward a center of the raft.

In accordance with certain embodiments, a method of constructing a raft may include providing a top surface, a bottom surface, a plurality of longitudinal stringers, and hull sides. The method further includes attaching an upper inner face of the top surface to the plurality of longitudinal stringers, wherein the plurality of longitudinal stringers runs from a bow of the raft to a stern of the raft. The method may further include fixing an inner facing surface of the top bottom surface to the plurality of longitudinal stringers; and attaching a plurality of hull sides, wherein the plurality of hull sides is attached to the upper inner face and the lower inner face, and the plurality of hull sides are curved toward a center of the raft.

BRIEF DESCRIPTION OF THE DRAWINGS

The accompanying drawings, which are included to provide a further understanding of example embodiments and are incorporated in and constitute a part of this specification, illustrate certain embodiments of the invention and together with the detailed description serve to explain the principles of certain embodiments. In the drawings.

DETAILED DESCRIPTION

In the following detailed description of certain embodiments, reference is made to the accompanying drawings that form a part hereof. These embodiments are described in sufficient detail to enable those skilled in the art to practice the invention, and it is understood that other embodiments may be utilized and that logical or structural changes may be made without departing from the spirit or scope of this disclosure. To avoid detail not necessary to enable those skilled in the art to practice the embodiments described herein, the description may omit certain information known to those skilled in the art. The following detailed description is, therefore, not to be taken in a limiting sense.

The features, structures, or characteristics of the invention described throughout this specification may be combined in any suitable manner in one or more embodiments. For example, the usage of the phrases "certain embodiments," "some embodiments," or other similar terminology throughout this specification refers to the fact that a particular feature, structure, or characteristic described in connection with the embodiment may be included in at least one embodiment of the present invention.

Certain embodiments of the raft sampling bench have been designed to be used as a scientific bench for marine science surveys. Certain embodiments provide a low cost floating equipment suitable for use in various environments, including shallow subtidal zones.

Certain embodiments may use conventional, readily available materials and can weigh approximately 40 kilograms (kg), can have a draft of approximately 25 centimeters (cm), and can be configured to carry a load up to about 400 kg. Additionally, certain embodiments of the raft sampling bench may be easily transported in or on land vehicles such as pickup trucks or on roof racks of automobiles. The transportability of certain embodiments allows for easy study of coastal marine areas that can be difficult to access using conventional craft.

Figure 1A:
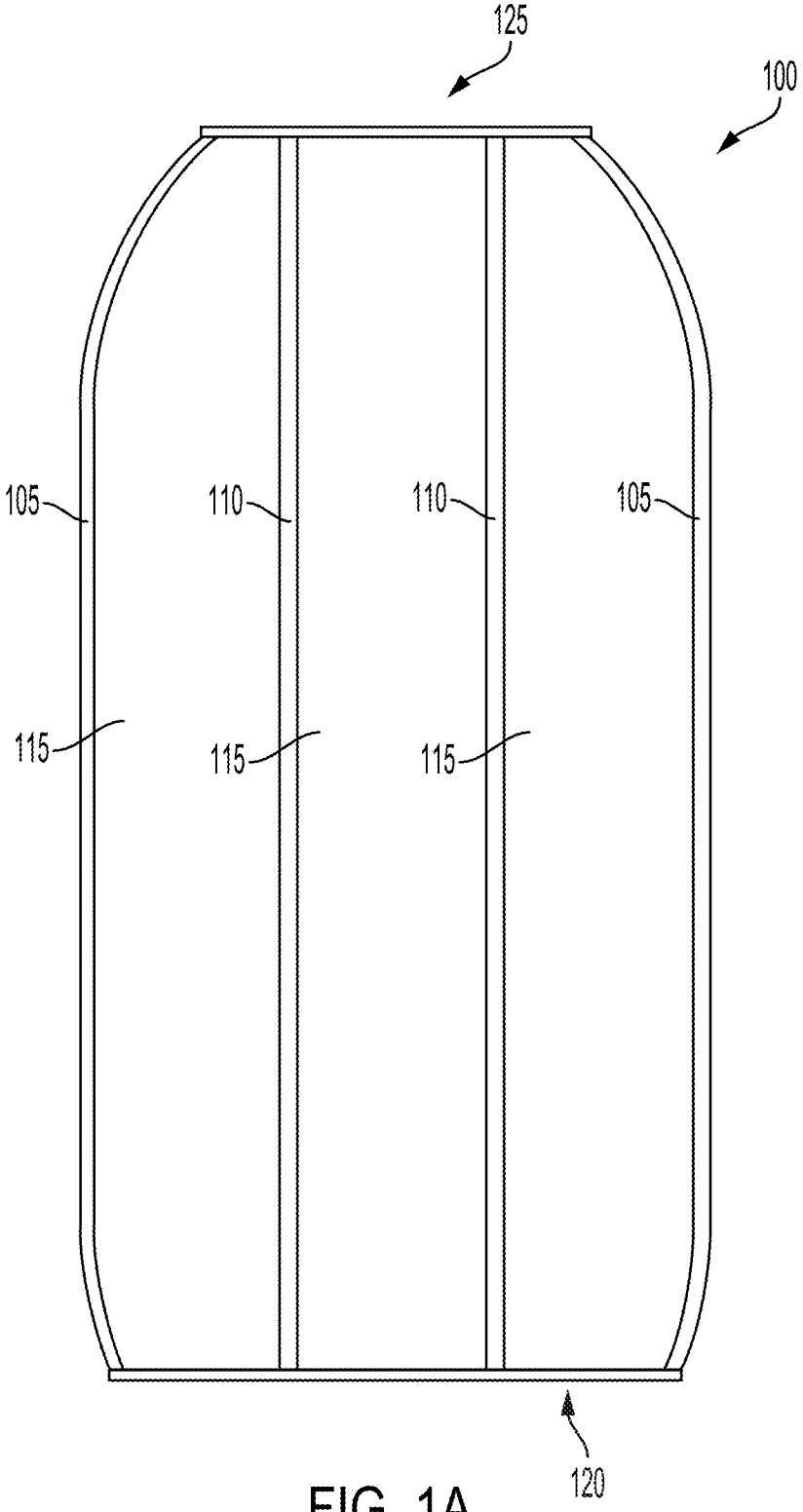
FIG. 1A illustrates a cross sectional view of a raft sampling bench according to certain embodiments.

FIG. 1A illustrates a cross sectional view of a raft sampling bench according to certain embodiments. The raft 100 has a bow 125 and a stern 120 at opposite ends. The bow 125 and stern 120 can be connected by hull sides 105 and longitudinal stringers 110. The longitudinal stringers 110 can be disposed in a parallel.

The area on the sides of the longitudinal stringers 110 can, in certain embodiments, be filled with a buoyancy material such as open cell foam, closed cell foam, air cells, polyurethane, ping-pong balls, etc., to create a floating cell 115. The bow 125 and stern 120 may be hydro-dynamically designed to move through water easily, to reduce splashing, and to retain stability in waves or uneven surface conditions. For example, the hull sides 105 may be curved at the ends to reduce drag in the water, or for other purposes.

Figure 1B:
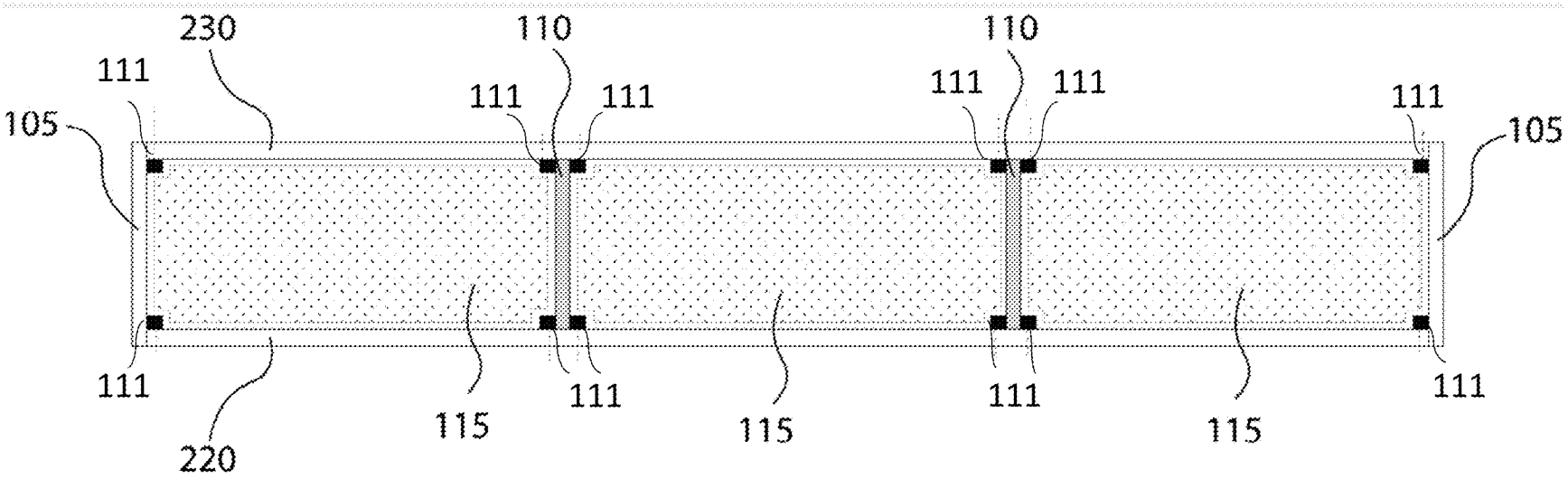
FIG. 1B illustrates a cross sectional view of a raft sampling bench according to certain embodiments.

FIG. 1B illustrates a cross sectional view of a raft sampling bench according to certain embodiments. Similar to FIG. 1A, FIG. 1B illustrates longitudinal stringers 110, hull sides 105, and floating cells 115. FIG. 1B further illustrates bottom surface 220, top surface 230, and brackets 111. Bottom surface 220 and top surface 230 will be discussed below. Brackets 111 may be made of light wood sticks, aluminum, plastic, stainless steel, normal steel, or the like. The brackets 111 may be used to connect the exterior surfaces of the raft such as the bottom surface 220, top surface 230, the bow, the stern, and the hull sides 105 to the longitudinal stringers 110.

Figures 2A, 2B:
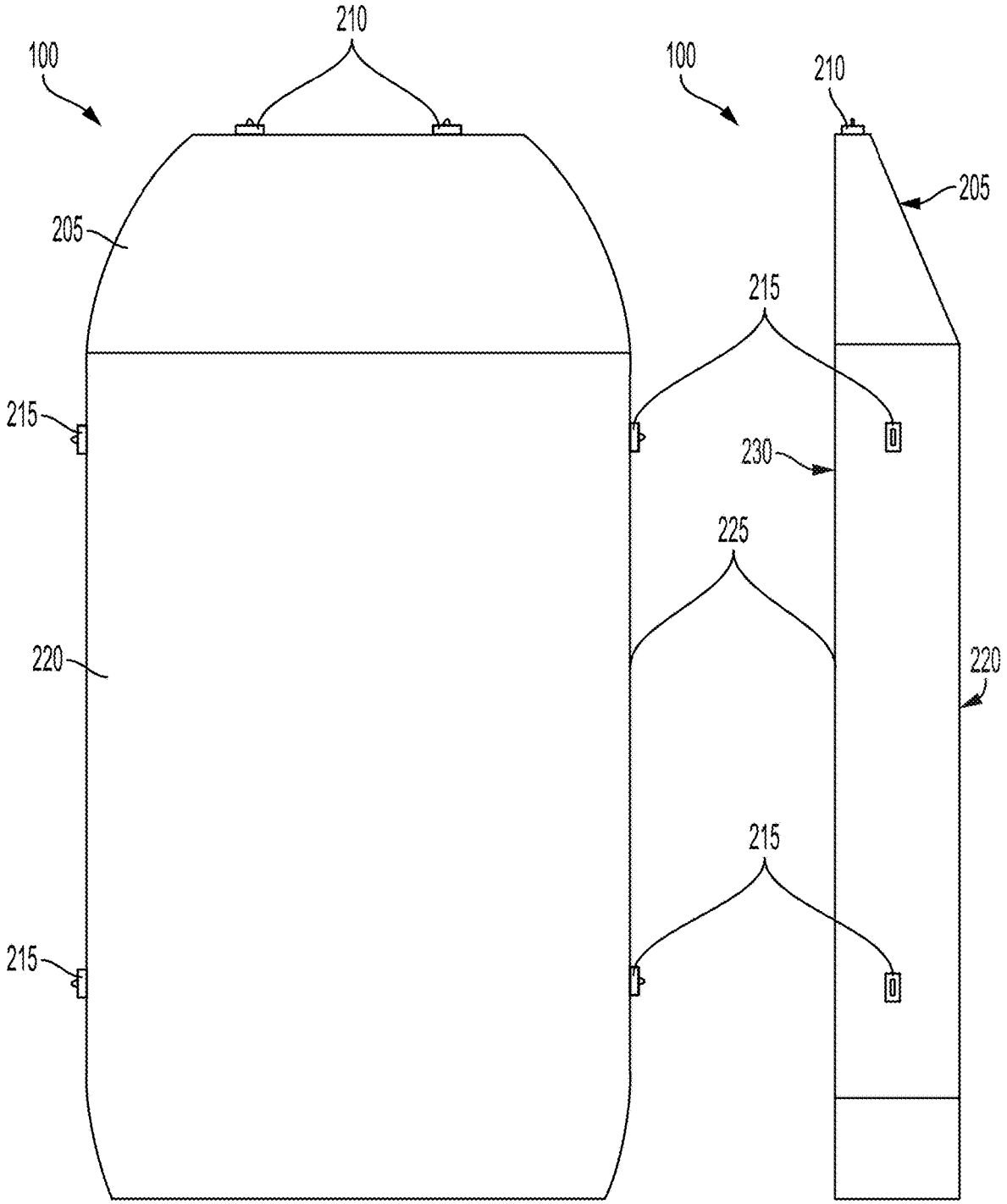
FIG. 2A illustrates a bottom view of a raft sampling bench according to certain embodiments.
FIG. 2B illustrates a side view of a raft sampling bench according to certain embodiments.

FIG. 2A illustrates bottom view and FIG. 2B illustrates a side view of a raft sampling bench according to certain embodiments. Raft 100 includes a bottom surface 220, and top surface 230. In this example, bottom surface 220 is flat, which can enhance stability and helps provide shallow draft. Near the bow of raft 100, bottom surface 220 may be an inclined surface 205 to further reduce drag in the water. The longitudinal stringers 105 and hull sides 110 can attach to the inner surfaces of the top surface 230 and bottom surface 220.

Raft 100 may also include securing points 210 and 215, which can be cleats, eyes, loops, "D" rings, or other suitable devices. Securing points 210 and 215 may allow for ease in securing raft 100, attaching objects to raft 100, or towing raft 100. In certain embodiment, perimeter edge 225 of top surface 230 is square, 90 degrees, to allow use as a scientific bench for studying surveyed material still in situ (e.g., material recently removed from water). In particular, the perimeter edge may include the joint between the top surface 230 and a side surface of the raft which may include hull sides 105 and vertical surfaces at the bow 125 and stern 120. The top surface 230 can be flat.

Figure 3A:
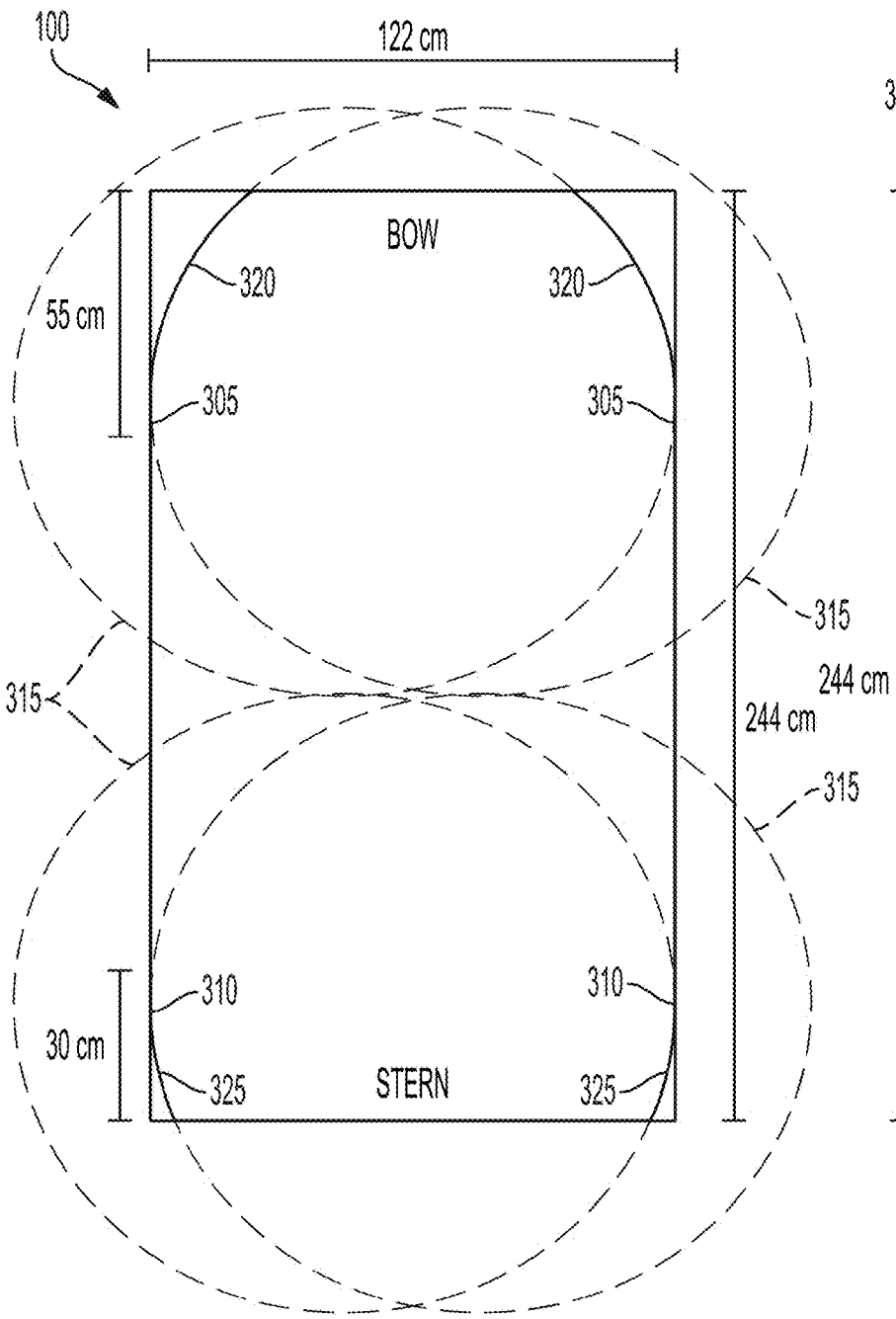
FIG. 3A illustrates a design of a raft sampling bench according to certain embodiments.
Figure 3B:
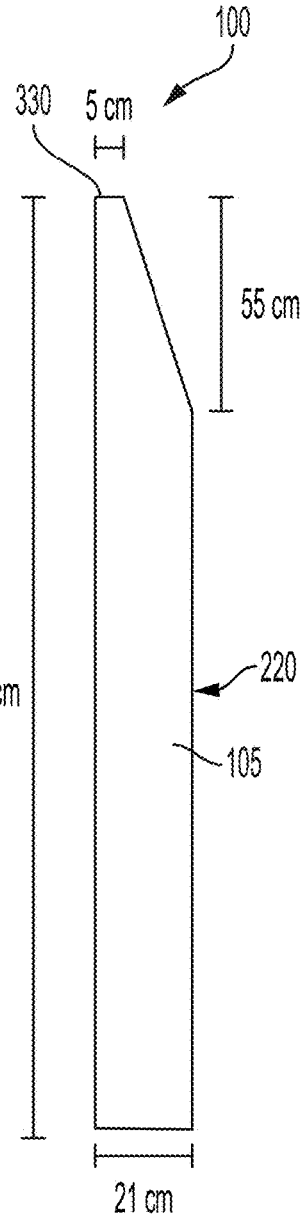
FIG. 3B illustrates a design of a raft sampling bench according to certain embodiments.

FIGS. 3A and 3B illustrate a design of a raft sampling bench according to certain embodiments. In this example, the top surface 230 and bottom surface 220 may each be constructed from sheet material, such as plywood, plastic, fiberglass, carbon fiber, polypropylene, composite, graphene, aluminum, etc. An exemplary size can be, for example, 244 cm long by 122 cm wide. An example of the curvature of the outer longitudinal stringers 105 can be determined by a circle 315 with a diameter of 150 cm that is tangent to the hull sides 105 on each side of raft 100 at 55 cm from the bow 125, and 30 cm from the stern 120. The front arc 320 of the circle 315 between the front tangent 305 and the bow 125 and back arc 325 of the circle 315 between the back tangent 310 and the stern 120 provide the curvature by which the hull sides 105 may be constructed to provide a hydro-dynamic shape to raft 100. These dimensions are for illustrative purposes only, and other dimensions can be used without deviating from the spirit and scope of the invention.

FIG. 3B also illustrates an inclined surface 205 for the bottom surface according to this example. The inclined surface 205 may begin at the same place as the front arc 320 of circle 315, 55 cm from the bow 125, and continue forward until the inclined surface 205 intersects with bow 125. The bow 125 may have a front surface 330 5 cm tall that is perpendicular to the top surface 230 that joins with the inclined surface 330. As shown in FIGS.2A-B and 4A-B, inclined surface 205, bottom surface 220, and/or top surface 230 may be a plane.

In this example, two longitudinal 110 stringers may be used. Other stringer configurations could also be used. The space on the sides of the longitudinal stringers 110 may be filled with buoyancy material. Each floating cell 115 can be isolated from each other by the longitudinal stringers 110. The bottom surface 220 is attached to the longitudinal stringers 110 and hull sides 105 to seal the structure of the raft 100. The top surface 230 and bottom surface 220 may be connected at the bow 125 and the stern 120 with brackets 111 (e.g. longitudinal light wood sticks).

Certain embodiments may be assembled using the hollow wooden method. The different structural pieces may be assembled with screws and wood glue. The wood glue may be used to seal the inner of the raft structure, and the external sealing may be performed using a suitable coating such as epoxy paint. The inner sealing may also be plastic, glue, epoxy, tar, resin, and/or sealing tapes to provide a waterproof coating and sealing to the joints. The external sealing may also include fiberglass, carbon fiber, epoxy, weld and further material that connect the embodiment's joints, which seals externally the inner floating cells. An antifouling coating might be considered in any embodiment to avoid the biofouling. The epoxy with sand may also be used to provide a non-slip surface on the top surface 230.

The height of the raft may be determined based on the target buoyancy and the Archimedes Principle. The Archimedes Principle states, $F_b=\rho\times g\times V$, where $F_b$ is the buoyant force, $\rho$ is the density of the fluid, V is the submerged volume, and g is the acceleration due to gravity. In this example, the target submergible volume is 0.45 to 0.6 $m^3$, where 1 $m^3$ displaces 1026 kg of salt water. Accordingly, the raft may be 21 cm tall. Therefore, with the target submergible volume and total raft weight of 42 kg, the buoyancy of the raft is able to carry a load of more than 400 kg in sea water as shallow as 25 cm.

Certain embodiments illustrated in FIGS. 3A and 3B may be constructed from conventional, readily available materials, and used in surveys in mangroves and other ecosystems that can be difficult to access. The example allowed the transportation of samples of water, sediment, and biota, in shallow waters for a distance of more than 1 kilometer.

Figure 4A:
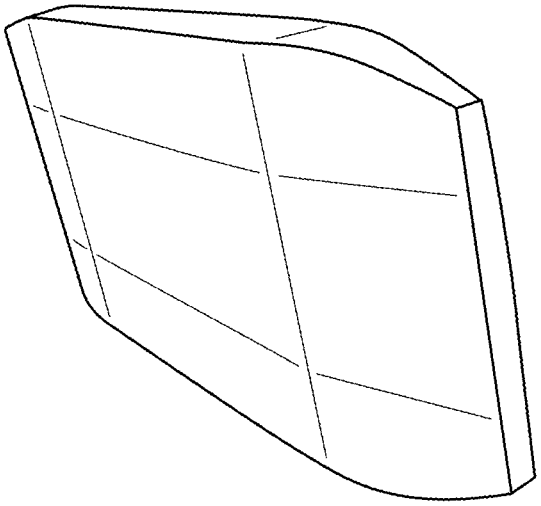
FIG. 4A illustrates a raft sampling bench according to certain embodiments.
Figure 4B:
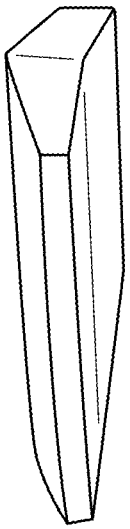
FIG. 4B illustrates a raft sampling bench according to certain embodiments.

FIGS. 4A and 4B illustrate a raft sampling bench according to certain embodiments described in FIGS. 3A and 3B. The raft sampling bench may be constructed using aeromodelling, hollow wooden methods, submarine or vessel floating concepts, and modern wood boat sealing methods. Other types of construction may include external. A rigid body/frame may be assembled with brackets (e.g., wood, steel, aluminum, etc. . . . ) and covered with plywood/plastic sheets (e.g., wood, steel, aluminum, graphene, etc. . . . ), sealed internally with mechanic gasket (e.g., plastic glue, epoxy, tar, weld, resin, rubber, elastomer, etc. . . . ), and externally (e.g., nautical epoxy, antifouling coating, fiberglass, carbon fiber, etc. . . . ). The interior may be filled with a floating material such as expanding polyurethane.

Although the foregoing description is directed to a certain embodiments of the invention, it is noted that other variations and modifications will be apparent to those skilled in the art, and may be made without departing from the spirit or scope of the invention. Moreover, features described in connection with one embodiment may be used in conjunction with other embodiments, even if not explicitly stated above.

The invention claimed is:

1. A marine raft, comprising:

a bow;

a stern, wherein the bow is an opposite end of the raft from the stern;

a top surface;

a plurality of longitudinal stringers, wherein the plurality of longitudinal stringers is attached to an upper inner face of the top surface and runs from the bow to the stern;

a bottom surface, wherein a lower inner face of the bottom surface is attached to the plurality of longitudinal stringers, wherein the lower inner face comprises a first plane and a second plane, wherein the first plane is perpendicular with the top surface, and wherein the second plane is disposed between the first plane and the bow; and a plurality of hull sides, wherein the plurality of hull sides are perpendicularly attached to the upper inner face and the lower inner face, and the plurality of hull sides are curved toward a center of the raft.

2. The marine raft according to claim 1, further comprising:

at least one floating cell, wherein a floating cells comprises a buoyancy material disposed on a side of a longitudinal stringer of the plurality of longitudinal stringers, and the floating cells are configured to provide buoyancy.

3. The marine raft according to claim 2, wherein the buoyancy material comprises at least one of foam or air cells.

4. The marine raft according to claim 1, wherein the plurality of longitudinal stringers are disposed in a parallel configuration.

5. The marine raft according to claim 4, wherein the hull sides are curved at the bow and the stern according to a radius of a circle.

6. The marine raft according to claim 1, wherein a height of the raft is determined based on Archimedes' principle and the raft being configured to support a load of more than 400 kilograms.

7. The marine raft according to claim 1, wherein the bottom surface comprises an inclined surface at the bow.

8. The marine raft according to claim 1, wherein a perimeter edge comprising the joint between top surface and the plurality of hull sides forms an angle of 90 degrees.

9. The marine raft according to claim 1, wherein each side of the raft comprises a plurality of securing points.

10. The marine raft according to claim 1, wherein the raft is configured to have a draft of 25 centimeters or less.

11. A method of constructing a raft, comprising:

providing a top surface, a bottom surface, a plurality of longitudinal stringers, and hull sides, wherein a lower inner face of the bottom surface is attached to the plurality of longitudinal stringers, wherein the lower inner face comprises a first plane and a second plane, wherein the first plane is perpendicular with the top surface, and wherein the second plane is disposed between the first plane and a bow of the raft;

attaching an upper inner face of the top surface to the plurality of longitudinal stringers, wherein the plurality of longitudinal stringers runs from the bow of the raft to a stern of the raft;

fixing an inner facing surface of the top bottom surface to the plurality of longitudinal stringers; and attaching a plurality of hull sides, wherein the plurality of hull sides are perpendicularly attached to the upper inner face and the lower inner face, and the plurality of hull sides are curved toward a center of the raft.

12. The method according to claim 11, further comprising:

creating at least one floating cell by disposing a buoyancy material on a side of a longitudinal stringer of the plurality of longitudinal stringers, wherein the floating cell is configured to provide buoyancy.

13. The method according to claim 12, wherein the buoyancy material comprises at least one of foam or air cells.

14. The method according to claim 11, wherein the plurality of longitudinal stringers are disposed in a parallel configuration.

15. The method according to claim 14, wherein the hull sides are curved at the bow and the stern according to a radius a circle.

16. The method according to claim 11, wherein a height of the raft is determined based on Archimedes' principle and the raft being configured to support a load of more than 400 kilograms.

17. The method according to claim 11, wherein the bottom surface comprises an inclined surface at the bow.

18. The method according to claim 11, wherein a perimeter edge comprising the joint between top surface and the plurality of hull sides forms an angle of 90 degrees.

19. The method according to claim 11, wherein each side of the raft comprises a plurality of securing points.

20. The method according to claim 11, wherein the raft is configured to have a draft of 25 centimeters or less.

* * * * *